US008851007B2

(12) United States Patent
Yarbrough

(10) Patent No.: US 8,851,007 B2
(45) Date of Patent: Oct. 7, 2014

(54) FOOD TOPPING DEVICE

(76) Inventor: Justin Yarbrough, Dallas, TX (US)

( * ) Notice: Subject to any disclaimer, the term of this patent is extended or adjusted under 35 U.S.C. 154(b) by 721 days.

(21) Appl. No.: 12/903,767

(22) Filed: Oct. 13, 2010

(65) Prior Publication Data

US 2012/0090538 A1 Apr. 19, 2012

(51) Int. Cl.

| | |
|---|---|
| ***B05C 11/04*** | (2006.01) |
| ***B26B 25/00*** | (2006.01) |
| ***B26B 11/00*** | (2006.01) |
| *B05C 19/04* | (2006.01) |

(52) U.S. Cl.

CPC ..... *B26B 25/005* (2013.01); *B26B 11/00* (2013.01); *B05C 19/04* (2013.01)

USPC ..... 118/13; 118/15; 118/23; 118/24; 118/35; 222/191; 222/192; 222/175; 222/80; 30/292; 30/307; 30/319; 30/365; 30/263; 30/123.3; 30/289; 7/110; 7/113

(58) Field of Classification Search

CPC ..... B26B 11/00; B26B 25/005; B05C 19/04

USPC ..... 118/13, 15, 23, 24, 35; 401/195; 426/518, 302–305, 289; 427/180, 289; 222/192, 175, 80, 191; 30/292, 306, 30/307, 319, 365, 287, 151, 263, 123, 30/123.3, 289; 83/932; 7/110, 113; D3/18; D8/98

See application file for complete search history.

(56) References Cited

U.S. PATENT DOCUMENTS

| | | | | |
|---|---|---|---|---|
| 4,146,943 | A * | 4/1979 | Wertheimer et al. | 15/111 |
| 5,428,898 | A * | 7/1995 | Hawkins | 30/295 |
| 6,247,736 | B1 * | 6/2001 | Esterson et al. | 294/7 |
| 6,505,746 | B1 * | 1/2003 | Johnson | 211/70.7 |
| 6,554,163 | B1 * | 4/2003 | Kaye | 222/80 |
| 7,325,994 | B2 * | 2/2008 | Liberatore | 401/266 |
| 8,051,570 | B1 * | 11/2011 | Brown | 30/123.3 |
| 2007/0080176 | A1 * | 4/2007 | Hunter | 222/192 |
| 2008/0289189 | A1 * | 11/2008 | Khatchadourian | 30/125 |
| 2009/0297248 | A1 * | 12/2009 | Martin, Jr. | 401/143 |

* cited by examiner

*Primary Examiner* — Laura Edwards
(74) *Attorney, Agent, or Firm* — Baker Botts L.L.P.

(57) ABSTRACT

A food topping and cutting device includes a handle coupled to a cutting edge, and further includes a container coupled to the handle. The container has a dispenser at one end configured to dispense, adjacent to the cutting edge, a food topping supplied from the container.

16 Claims, 4 Drawing Sheets

FOOD TOPPING DEVICE

TECHNICAL FIELD OF THE DISCLOSURE

The present disclosure relates generally to devices for dispensing food toppings and more particularly to a device that may simultaneously cut a food item while dispensing food toppings onto the food item.

BACKGROUND OF THE DISCLOSURE

Preparation of various food items often requires many tasks including cooking, baking, seasoning, topping, and/or cutting the food items. These tasks can be both time-consuming and tedious, and may impede the goal of preparing and consuming a particular food item in an expeditions manner.

BRIEF DESCRIPTION OF THE DRAWINGS

For a more complete understanding of particular embodiments and their advantages, reference is now made to the following description, taken in conjunction with the accompanying drawings, in which.

DETAILED DESCRIPTION OF EXAMPLE EMBODIMENTS

Overview

Preparation of various food items for consumption often requires many tasks. For example, after cooking pancakes, it is common to pour one or more toppings (e.g., syrup, butter, and powdered sugar) onto the pancakes before eating them. This usually requires a consumer to go through the process of locating the container that houses the desired topping, opening the container, and pouring the topping onto to the pancakes. Applying toppings in this manner can become a very tedious task, particularly when more than one topping is used. After the topping has been poured onto the pancakes, the consumer will often need to cut the pancakes into smaller pieces. This too can be a very tedious task, usually requiring the consumer to use a knife and fork to cut the pancakes, one piece at a time.

The multi-step process described above may have a number of drawbacks. For example, the process of applying a topping before cutting the pancake may result in the pancakes becoming cold or soggy. It may also result in toppings being wasted due to run-off of the topping from the pancakes. Additionally, the multi-step process described above may require multiple devices, such as a knife, fork, and a container for each topping. Setup and cleanup become increasingly tedious with each device or apparatus involved. Given these and other drawbacks, there is a need for a device that is capable of cutting a food item, such as pancakes, while simultaneously dispensing one or more toppings onto the food item. The technical advantages of such a device could alleviate many shortcomings associated with preparing and eating food. For example, using a only single device for both cutting and applying a food topping to a food item may reduce setup and cleanup time. Additionally, by using a device that can simultaneously cut and apply a food topping to a food item, the freshness of the food item may be maintained for a longer period of time.

In accordance with a particular embodiment, a food topping and cutting device includes a handle coupled to a cutting edge, and further includes a container coupled to the handle. The container has a dispenser at one end configured to dispense, adjacent to the cutting edge, a food topping supplied from the container.

DESCRIPTION OF EXAMPLE EMBODIMENTS

Figure 1:
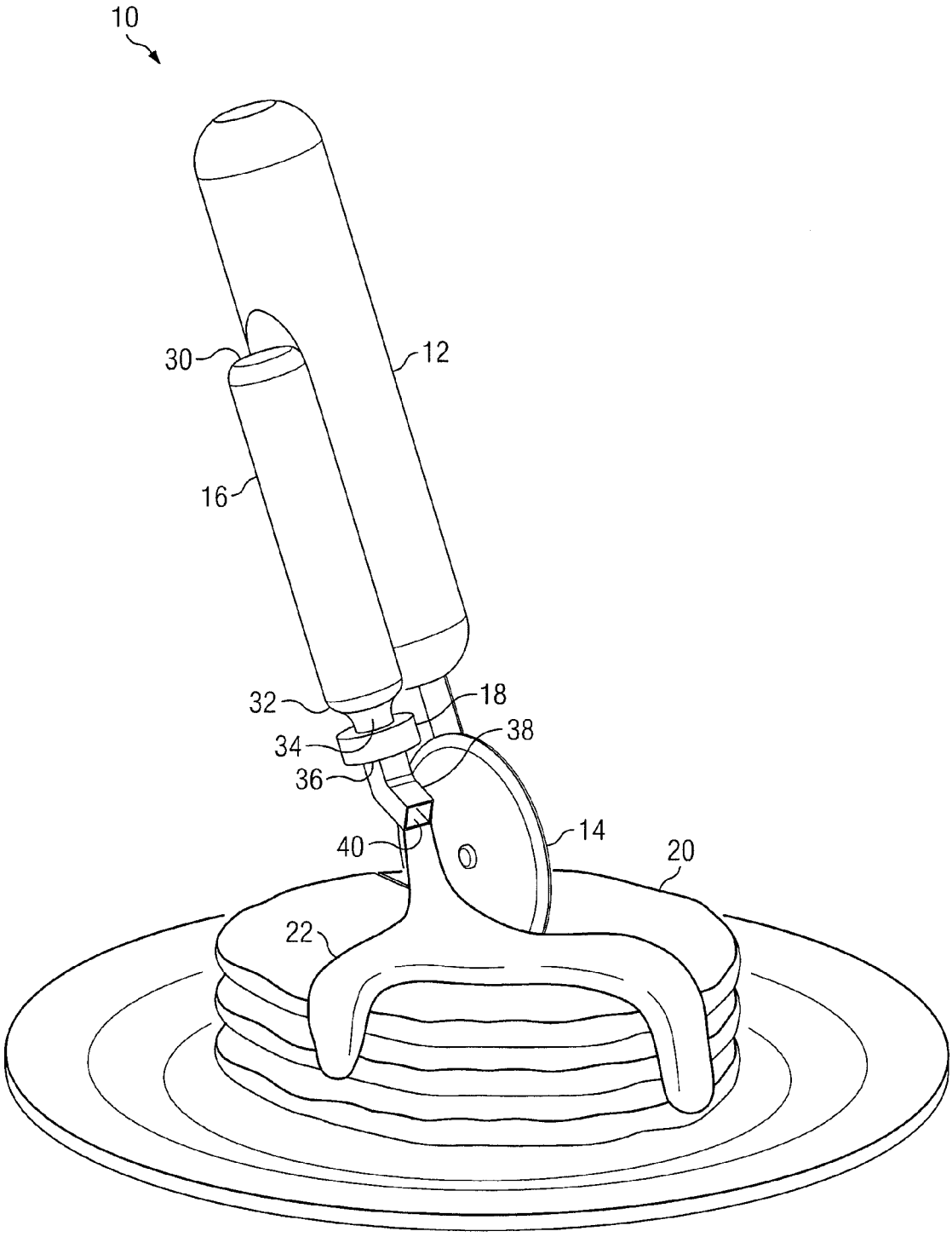
FIG. 1 illustrates a food topping and cutting device that may be used to simultaneously cut a food item while dispensing a food topping onto the food item in accordance with particular embodiments of the present disclosure.

FIG. 1 illustrates a device 10 that is being used to simultaneously cut a food item 20 while dispensing a food topping 22 onto food item 20 in accordance with particular embodiments of the present disclosure. Depending upon design, device 10 may include a handle 12, a container 16, a cutting edge 14, and a dispenser 18.

In a typical scenario, a consumer would use device 10 to cut food item 20 by grasping handle 12, positioning cutting edge 14 onto food item 20, and drawing cutting edge 14 across food item 20 such that cutting edge 14 cuts food item 20. At the same time, the consumer may also use device 10 to add food topping 22 to food item 20 by triggering dispenser 18 to dispense food topping 22 onto food item 20.

Handle 12 may be any component or fixture of hardware connected to cutting edge 14, capable of allowing a consumer to exert mechanical force on cutting edge 14. As an example and not by way of limitation, handle 12 may be a generally elongate tubular rod, approximately one inch in diameter and approximately four inches long, that is firmly connected to cutting edge 14. This is but one suitable embodiment for handle 12. The present disclosure contemplates handle 12 being any suitable size and any suitable shape. Further, handle 12 may be composed of any material suitable for household use such as wood, metal, or plastic.

Cutting edge 14 may be any component or fixture of hardware connected to handle, capable of slicing through food item 20 (e.g., a pancake). As an example and not by way of limitation cutting edge 14 may be the sharpened edge of a knife blade. As another example and not by way of limitation, cutting edge 14 may be the sharpened edge of a cutting wheel. In a typical configuration of food topping device 10, cutting edge 14 is firmly connected to handle 12 such that handle 12 transmits mechanical force from the consumer to cutting edge 14. Thus, by applying mechanical force to handle 12, a consumer may use cutting edge 14 to cut food item 20. These are but a few suitable embodiments for cutting edge 14. In some embodiments, cutting edge 14 is detachable from handle 12 to allow cutting edge 14 to be cleaned. The present disclosure contemplates cutting edge 14 being any suitable size and shape. Further, cutting edge 14 may be composed of any material suitable for cutting food such as metal or plastic.

Container 16 may be any component or fixture of hardware configured to house food topping 22. Food topping 22 is typically a viscous liquid such as syrup or caramel. However, for certain applications, food topping 22 could be a flowable particulate such as grated parmesan cheese, granular salt, or ground pepper.

In one design, container 16 may be a generally elongate bottle coupled adjacent to handle 12. In another embodiment, container 16 may be incorporated into handle 12, such that container 16 and handle 12 are one and the same. For example, in some embodiments, handle 12 may be hollow and the hollow portion of handle 12 may function as container 16 to house food topping 22. Container 16 typically includes a sealed end 30 and open end 32. Open end 32 typically includes a coupling mechanism such as a threaded rim configured to mate with dispenser 18. Thus, in particular embodiments, a consumer may attach and detach container 16 from dispenser 18. In this manner, when food topping 22 has been completely dispensed from container 16, container 16 may be refilled with more food topping 22. In other embodiments, container 16 is detachable from food topping device 10. In this manner, when food topping 22 has been completely dispensed from container 16, container 16 may be replaced by another container that is pre-filled with more food topping 22. Further, container 16 may be composed of any material suitable for housing food topping 22 such as metal, plastic, or ceramic. In some embodiments, container 16 may be composed of a flexible material such as plastic or any other suitable flexible material to enable a user to squeeze food topping 22 out of container 16. In embodiments where container 16 is detachable from food topping device 10, container 16 may be composed of a microwavable material to allow heating of food topping 22 by placing container 16 in a microwave.

In some embodiments, device 10 may include more than one container/dispenser set. For example, in some embodiments, device 10 may include one container/dispenser set on each side of handle 12. In those embodiments, each container 16 may house a different food topping 22, allowing device 10 to dispense more than one food topping 22 at a time. Dispenser 18 may be any component or fixture of hardware capable of controllably dispensing food topping 22 from container 16. As an example and not by way of limitation, dispenser 18 may be a nozzle having a coupling end 34 and a dispensing end 36. Coupling end 34 may be responsible for coupling dispenser 18 to the open end 32 of container 16. As an example and not by way of limitation, coupling end 34 may be a threaded cap configured to screw onto a threaded rim of container 16. Although any suitable mechanism may be used to couple container 16 to dispenser 18, it is generally desirable to have a water tight seal between those two components.

Dispensing end 36 may be responsible for releasing food topping 22 from container 16. As an example and not by way of limitation, dispensing end 36 may be a tubular protrusion 38 extending from coupling end 34 having an opening 40 through which food topping 22 may flow. In particular embodiments, dispensing end 36 may be positioned adjacent to cutting edge 14 to enable dispenser 18 to dispense food topping 22 onto the portion of food item that is being cut by cutting edge 14.

In particular embodiments, a consumer may trigger dispenser 18 to dispense food topping 22 by tilting device 10 at an appropriate angle until food topping 22 begins to flow out of opening 40. Although this particular embodiment utilizes tilting to dispense food topping 22 from dispenser 18, any suitable mechanism may be used to dispense food topping housed by container 16.

Figure 2A:
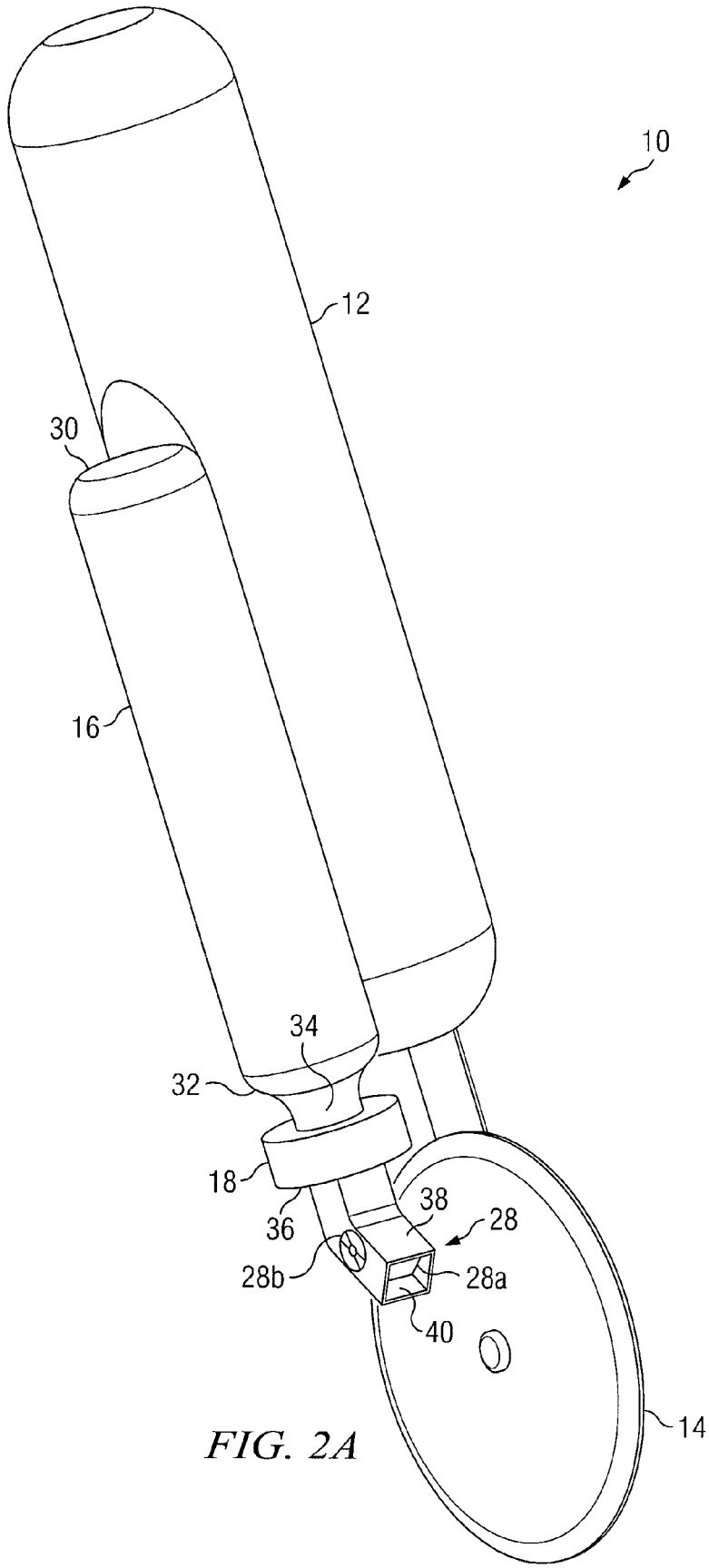
FIGS. 2A-2B illustrate examples of a food topping and cutting device comprising a rate control mechanism configured to control the rate at which food topping is dispensed in accordance with particular embodiments of the present disclosure.
Figure 2B:
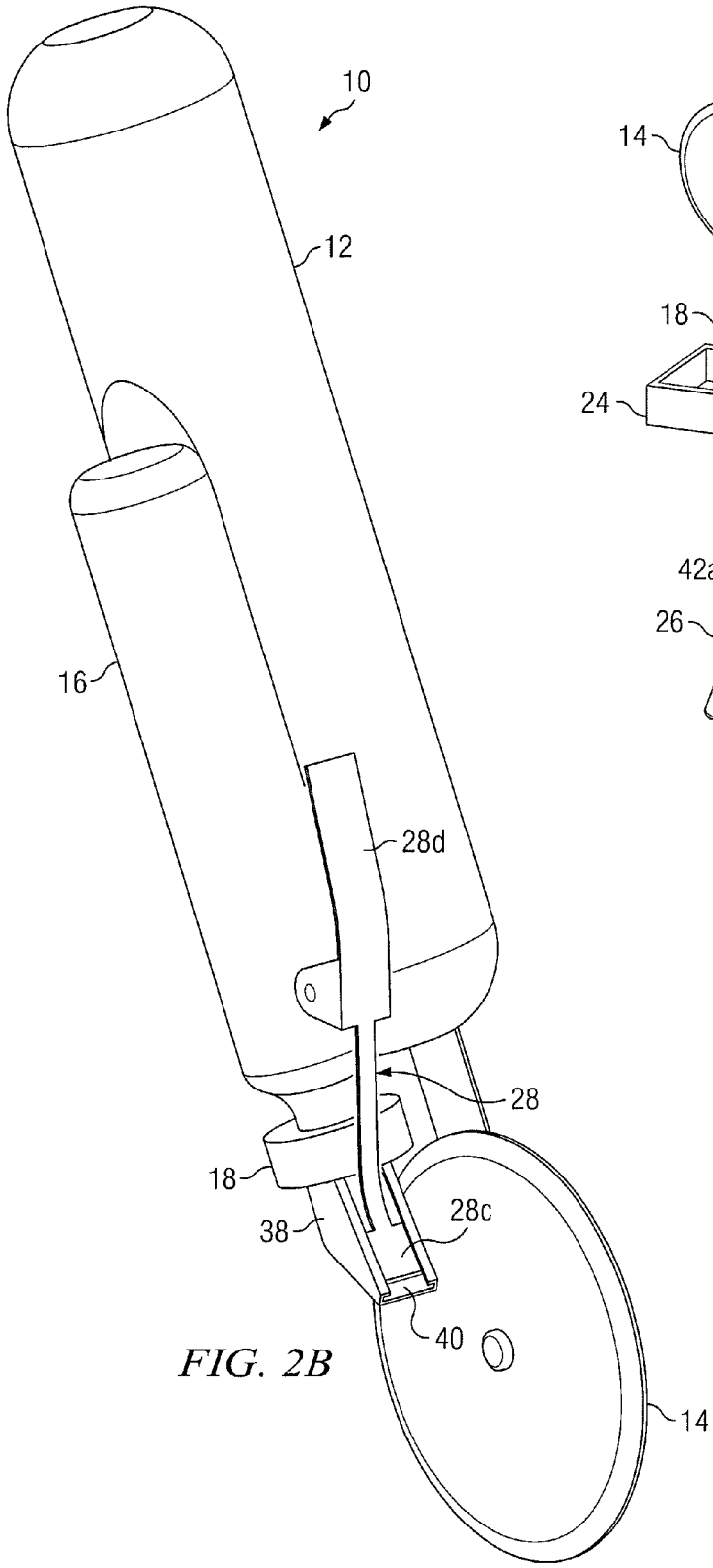

FIGS. 2A-2B illustrate examples of a food topping device 10 comprising a rate control mechanism 28 in accordance with particular embodiments of the present disclosure. In particular embodiments rate control mechanism 28 may be configured to control the rate at which food topping 22 is dispensed from opening 40. As an example and not by way of limitation, as shown in FIG. 2A, rate control mechanism 28 may be a valve 28*a* placed inside of tubular protrusion 38 that a user may adjust using a valve control 28*b* to control the flow of food topping 22. As another example and not by way of limitation, as shown in FIG. 2B, rate control mechanism 28 may be a sliding door 28*c* overlying opening 40 that a user may use to adjustably obstruct opening 40 to control the flow of food topping 22 via a trigger mechanism 28*d*.

Figure 3:
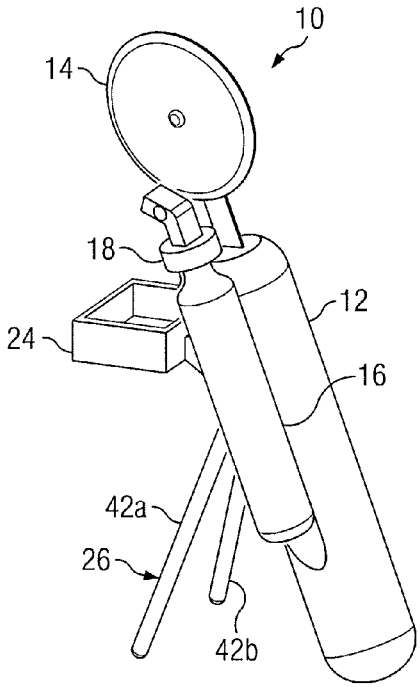
FIG. 3 illustrates a food topping and cutting device including a stand configured to support the device in an upright position and further including a drip tray to configured to catch excess food topping that drips from the device, in accordance with particular embodiments of the present disclosure.

FIG. 3 illustrates an embodiment of a food topping device 10 including a stand 26 and further including a drip tray 24 in accordance with particular embodiments of the present disclosure. Stand 26 may be used to place device 10 in an upright position on a surface when the consumer has finished using device 10. In embodiments where food topping 22 is a liquid such as syrup, drip tray 24 may be positioned to catch any excess food topping 22 that runs off of cutting edge 14 when the consumer sets device 10 down on a surface.

Stand 26 may be any component or fixture of hardware coupled to device 10 capable of supporting device 10 on a surface in an upright position generally perpendicular to the surface. As an example and not by way of limitation, in some embodiments stand 26 may be a v-shaped fixture comprising two prongs 42*a* and 42*b* coupled to handle 12 and extending outward at an angle from handle 12. In those embodiments, when device 10 is placed on a surface in an upright position generally perpendicular to the surface, prongs 42*a* and 42*b* of the v-shaped fixture extend to the surface and support device 10 in the upright position. Although this particular embodiment utilizes a v-shaped fixture, any suitable mechanism may be used to support device 10 in an upright position generally perpendicular to a surface on which device 10 is placed. Further, stand 26 may be composed of any material suitable to support device 10 in the upright position, such as metal or plastic.

Drip tray 24 may be any component or fixture of hardware coupled to device 10 that is configured to catch excess food topping 22 that drips from device 10 when device 10 is held in the upright position. Drip tray 24 may be composed of any generally impermeable material, such as metal or plastic, that is suitable for catching excess food topping 22 that may drip off cutting edge 14 while device 10 is held in the upright position. As an example and not by way of limitation, drip tray 24 may be coupled to handle 12 and may extend outward from handle 12, such that drip tray 24 is positioned to reside directly beneath the lower-most portion of cutting edge 14 when device 10 is set in the upright position using stand 26. In this manner, excess food topping 22 that drips from cutting edge 14 may be caught by drip tray 24, rather than dripping onto the surface on which device 10 resides.

In particular embodiments, drip tray 24 may be positioned to reside directly beneath the lower-most portion of cutting edge 14 and beneath tubular protrusion 38 of dispenser 18. In those embodiments, when device 10 is set down on a surface, excess food topping 22 that drips from cutting edge 14 may be caught by drip tray 24, and excess food topping 22 that drips from tubular protrusion 38 may also be caught by drip tray 24.

Although these particular embodiments utilize a drip tray 24 coupled to handle 12 and positioned directly beneath cutting edge 14, any suitable mechanism capable of catching excess food topping 22 that drips from device 10 may be used.

Figure 4B:
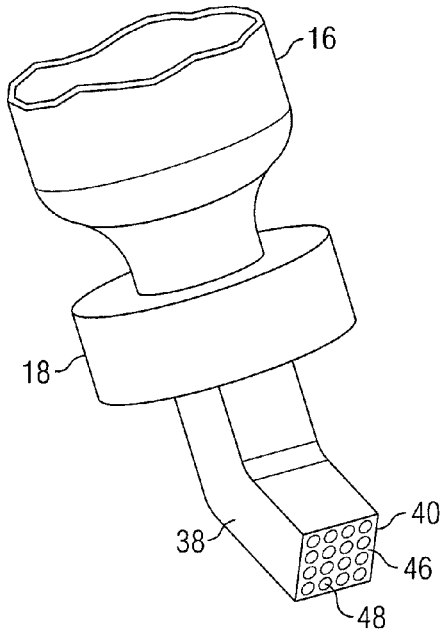
FIGS. 4A-4B illustrate a food topping and cutting device configured to dispense a flowable particulate in accordance with particular embodiments of the present disclosure.
Figure 4A:
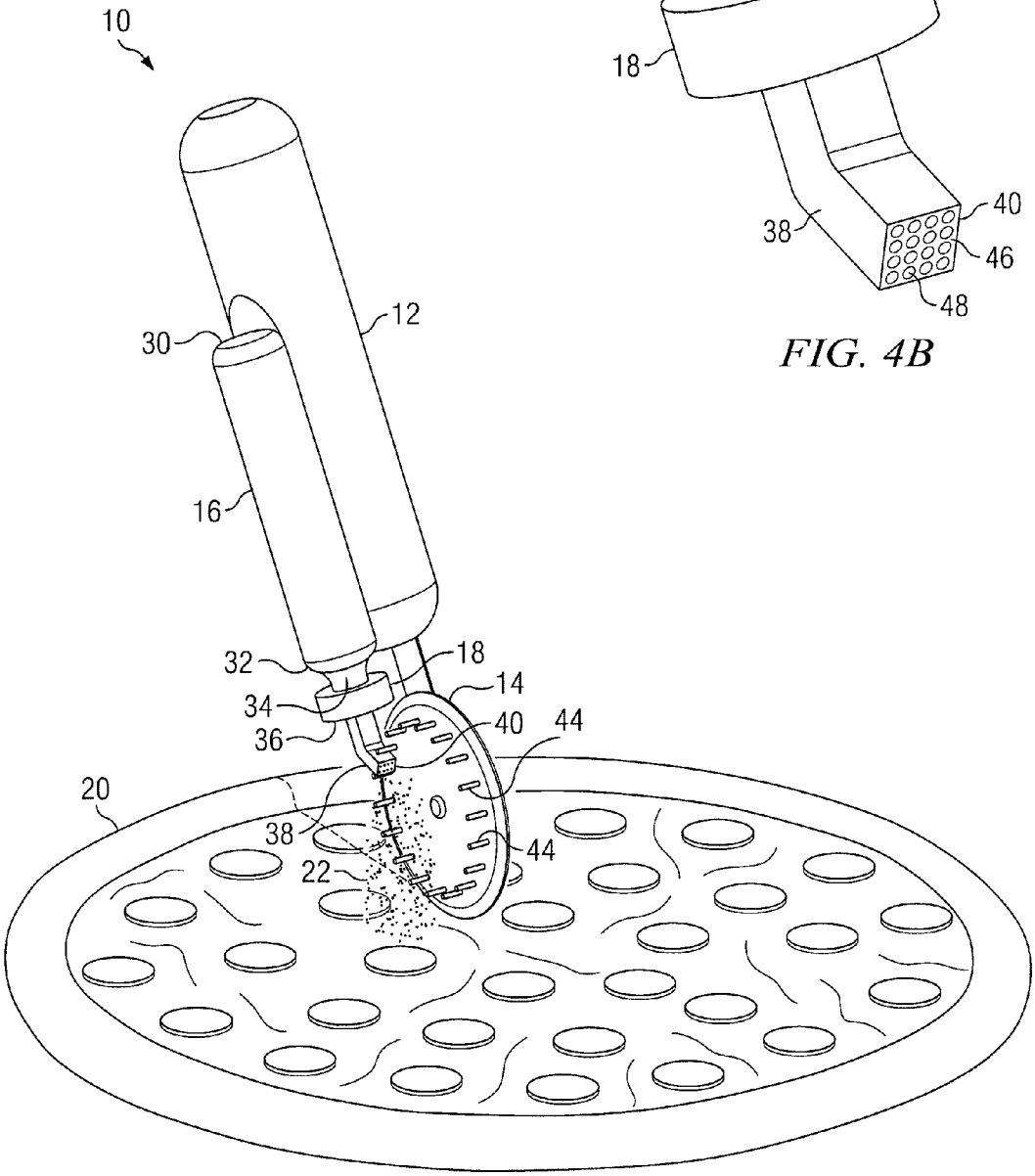

FIGS. 4A-4B illustrate an embodiment of a device 10 configured to dispense a flowable particulate. In embodiments where food topping 22 is a flowable particulate, as shown in FIG. 4A, cutting edge 14 may be the sharpened edge of a cutting wheel that includes a plurality of lateral tines 44.

Furthermore, tubular protrusion 38 may be composed of a supple material such as rubber that may be agitated by tines 44 as cutting wheel 14 spins. The agitation from tines 44 may cause tubular protrusion to vibrate, shaking a small amount of the flowable particulate out of opening 40 with each passing tine 44. As shown in FIG. 4B, in some embodiments opening 40 may further include a perforated grate 46 configured to prevent the flowable particulate from flowing out of opening 40 unimpeded. For example, perforated grate 46 may include perforations 48 roughly equal to the particle size of the flowable particulate. Perforated grate 46 may help dispense the flowable particulate at a measured rate depending on the size of perforations 48.

In particular embodiments, cutting edge 14 may form a pattern other than a straight line. In those embodiments, when cutting edge 14 is drawn across food item 20, the incision across food item 20 forms the pattern of cutting edge 14. As an example and not by way of limitation, cutting edge 14 may protrude laterally back and forth to form a zigzag pattern. In this manner, when device 10 is used to cut food item 20, the incision in food item 20 forms a zigzag. Cutting edge 14 may also form other patterns, such as an s-shaped or curved pattern. In some embodiments, cutting edge 14 may be the outer edge of a cutting wheel, and the outer edge of the cutting wheel may form the particular pattern. In those embodiments, device 10 may also be configured to dispense a flowable particulate, as described above. The lateral protrusions formed by the pattern around the outer edge of the cutting wheel may function as lateral tines 44. In this manner, when device 10 is used to cut food item 20, the lateral protrusions may agitate tubular protrusion 38, causing the flowable particulate to be dispensed from opening 40.

In particular embodiments, food topping device 10 may include a mechanism configured to allow the device 10 to be compacted for storage purposes. As an example and not by way of limitation, device 10 may include a hinge between handle 12 and cutting edge 14. The hinge may be configured to allow cutting edge 14 to be rotated towards handle 12 such that cutting edge 14 lays flat on top of handle 12. In other embodiments, any suitable mechanism may be used to allow device 10 to be compacted for storage purposes.

Although the present disclosure has been described with several embodiments, it should be understood that a myriad of changes, variations, alterations, transformations, and modifications may be suggested to one skilled in the art, and it is intended that the present disclosure encompass such changes, variations, alterations, transformation, and modifications as they fall within the scope of the appended claims.

What is claimed is:

1. A device for cutting a food item, comprising:

a handle coupled to a cutting edge;

a container coupled to the handle, the container having a dispenser at one end configured to dispense, adjacent to the cutting edge, a food topping supplied from the container, wherein the dispenser is interchangeable to allow dispersion of different food toppings;

wherein the dispenser comprises:

a threaded bottle cap configured to screw onto the container;

a tubular protrusion extending from one side of the cap, the tubular protrusion having an opening through which the food topping may flow wherein the tubular protrusion comprises a flexible material and includes a perforated grate at one end; and wherein the cutting edge is the edge of a cutting wheel coupled to the handle, the cutting wheel comprising a plurality of lateral tines configured to agitate the tubular protrusion when the cutting wheel spins.

2. The device of claim 1, wherein the dispenser further comprises a rate control mechanism operable to control a rate at which the dispenser dispenses the food topping.

3. The device of claim 2, wherein the rate control mechanism comprises a valve in the dispenser.

4. The device of claim 1, wherein the handle and the container are comprised in a single tubular body.

5. The device of claim 1, wherein the handle and the container are separate objects and the container is removeably coupled to the handle.

6. The device of claim 1, further comprising a stand operable to hold the device in an upright position such that the cutting edge is substantially perpendicular to a flat surface on which the device is placed.

7. The device of claim 6, further comprising a drip catch tray positioned such that it resides directly beneath the lowermost portion of the cutting edge when the device is in the upright position.

8. A device for cutting food, comprising:

a handle coupled to a circular cutting wheel; and a container coupled to the handle, the container having a dispenser at one end configured to dispense, adjacent to an edge of the cutting wheel, a food topping onto the food when the cutting wheel cuts the food, wherein the dispenser is adjacent to the cutting wheel such that the food topping is dispensed simultaneously when the cutting wheel cuts the food, and wherein the dispenser is interchangeable to allow dispersion of different food toppings; and wherein the dispenser comprises:

a threaded bottle cap configured to screw onto the container, and a tubular protrusion extending from one side of the cap, the tubular protrusion having an opening through which the food topping may flow.

9. The device of claim 8, wherein the dispenser comprises a rate control mechanism operable to control a rate at which the dispenser dispenses the food topping.

10. The device of claim 9, wherein the rate control mechanism comprises a valve in the dispenser.

11. The device of claim 8, wherein the handle and the container are comprised in a single tubular body.

12. The device of claim 8, wherein the handle and the container are separate objects and the container is removeably coupled to the handle.

13. The device of claim 8, wherein the tubular protrusion comprises a flexible material and includes a perforated grate at one end.

14. The device of claim 13, wherein the cutting wheel comprises a plurality of lateral tines configured to agitate the tubular protrusion when the cutting wheel spins.

15. The device of claim 8, further comprising a stand operable to hold the device in an upright position such that the cutting edge is substantially perpendicular to a flat surface on which the device is placed.

16. The device of claim 15, further comprising a drip catch tray positioned such that it resides directly beneath the lowermost portion of the cutting edge when the device is in the upright position.

* * * * *